US009715976B2

(12) United States Patent
Huang

(10) Patent No.: US 9,715,976 B2
(45) Date of Patent: Jul. 25, 2017

(54) KEYBOARD DEVICE

(71) Applicant: Primax Electronics Ltd., Neihu, Taipei (TW)

(72) Inventor: Wei-Yung Huang, Taipei (TW)

(73) Assignee: PRIMAX ELECTRONICS, LTD., Taipei (TW)

( * ) Notice: Subject to any disclaimer, the term of this patent is extended or adjusted under 35 U.S.C. 154(b) by 0 days.

(21) Appl. No.: 14/691,172

(22) Filed: Apr. 20, 2015

(65) Prior Publication Data

US 2016/0268073 A1 Sep. 15, 2016

(30) Foreign Application Priority Data

Mar. 13, 2015 (TW) ..... 104108104 A

(51) Int. Cl.
*H01H 9/26* (2006.01)
*H01H 13/72* (2006.01)
(Continued)

(52) U.S. Cl.
CPC ..... *H01H 13/702* (2013.01); *H01H 2221/024* (2013.01); *H01H 2221/054* (2013.01); *H01H 2221/08* (2013.01)

(58) Field of Classification Search
CPC .. H01H 1/00; H01H 1/12; H01H 1/22; H01H 1/221; H01H 1/225; H01H 3/00; H01H 3/02; H01H 3/12; H01H 13/00; H01H 13/02; H01H 13/70; H01H 13/12; H01H 13/20; H01H 13/50; H01H 13/7006; H01H 13/705; H01H 13/86; H01H 2003/00; H01H 2003/02; H01H 2003/12; H01H 2201/00; H01H 2219/036; H01H 2233/033; H01H 3/161; H01H 5/00; H01H 5/04; H01H 13/04; H01H 13/10; H01H 13/22; H01H 13/26; H01H 13/52; H01H 13/7013; H01H 13/702; H01H 13/7057; H01H 13/7065; H01H 2003/127; H01H 2215/00; H01H 2215/004; H01H 2215/006;
(Continued)

(56) References Cited

U.S. PATENT DOCUMENTS 5,278,374 A * 1/1994 Takagi ..... H01H 3/125 200/344
5,767,464 A * 6/1998 Dyer ..... H01H 3/125 200/344
(Continued)

*Primary Examiner* — Anthony R. Jimenez
(74) *Attorney, Agent, or Firm* — Kirton McConkie; Evan R. Witt

(57) ABSTRACT

A keyboard device includes a base plate, a circuit board and plural keys. The base plate includes plural fixing parts. Each of the plural fixing parts includes two extension structures, an opening and a guiding slot. Each key includes a keycap and a metallic elastic element. The keycap includes plural positioning parts. The base plate includes plural fixing parts. The plural positioning parts are connected with the plural fixing parts, respectively. Each positioning part includes a positioning bulge. The positioning bulge is introduced into the guiding slot of the fixing part through the opening of the fixing part, so that the keycap is fixed on the base plate. When the keycap is depressed, the positioning bulge of the positioning part is moved downwardly within the guiding slot, so that the keycap is moved toward the base plate.

4 Claims, 6 Drawing Sheets

(51) Int. Cl.
*H01H 13/76* (2006.01)
*H01H 13/702* (2006.01)

(58) Field of Classification Search
CPC ..... H01H 2215/008; H01H 2215/012; H01H 2215/014; H01H 2215/034; H01H 2215/036; H01H 2237/00; H01H 2237/002; H01H 2233/07; H01H 2237/006; H01H 2237/008; H01H 2003/008; H01H 2215/05; H01H 13/85; G06F 1/1601; G06F 1/1626; G06F 1/1643; G06F 1/016; G06F 3/0202; G06F 3/03543; G06F 3/041; G08B 6/00; H01L 41/0474; H01L 41/083; H01L 41/0833; H01L 41/193; H01L 41/293
USPC ..... 200/5 A, 341, 344, 513, 516
See application file for complete search history.

(56) References Cited

U.S. PATENT DOCUMENTS 6,542,355 B1 * 4/2003 Huang ..... G06F 3/0202 312/223.2
8,822,858 B2 * 9/2014 Niu ..... H01H 13/83 200/308

* cited by examiner

KEYBOARD DEVICE

FIELD OF THE INVENTION

The present invention relates to a keyboard device, and more particularly to a keyboard device with plural keycaps and a base plate, in which the keycaps are directly connected with the base plate.

BACKGROUND OF THE INVENTION

As known, a keyboard device can provide an intuitional feedback-imparting interface for allowing the user to input signals to an electronic device in a simple manner. Even if most electronic devices are equipped with touch screens and virtual keyboards are shown on the touch screens for allowing users to input signals, physical keyboard are still frequently used by most users because the hand feel of touching the touch screen is lower than the tactile feedback of pressing the physical keyboard and the possibility of erroneously touching other keys of the touch screen is very high.

FIG. 1 is a schematic view illustrating a conventional keyboard device. As shown in FIG. 1, the conventional keyboard device 10 comprises plural keys 11, a circuit board 12 and a base plate 13. Each of the plural keys 11 comprises a keycap 111, a scissors member 112 and a rubbery elastomer 113. The keys 11 are disposed on the circuit board 12. The circuit board 12 is disposed on the base plate 13. In particular, the scissors member 112 is arranged between the keycap 111 and the rubbery elastomer 113 for connecting the keycap 111 and the base plate 13. The rubbery elastomer 113 is disposed on the circuit board 12 and located under the scissors member 112 for returning the keycap 111 to the original position. When the key 11 is depressed, the keycap 111 is moved downwardly to press the rubbery elastomer 113 so as to result in deformation of the rubbery elastomer 113. At the same time, the circuit board 12 is pressed by the rubbery elastomer 113 so as to generate a key signal. When the key 11 is no longer depressed, the rubbery elastomer 113 is restored to the original shape. Consequently, the keycap 111 is moved upwardly in the direction away from the base plate 13.

As mentioned above, the keycaps 111 are fixed on the base plate 13 through the scissors member 112 of the keyboard device 10, and the rubbery elastomer 113 of the keyboard device 10 provides the hand feed of pressing the key 11 to the user. Moreover, when the key 11 is no longer depressed by the user, the rubbery elastomer 113 can allow the keycap 111 of the key 11 to be returned to the original position. However, since the combination of the scissors member 112 and the rubbery elastomer 113 has certain height and volume, the overall height of the keyboard device 10 is increased.

In other words, it is an important issue to provide a keyboard device with slimness and hand feel. Therefore, there is a need of providing an improved keyboard device in order to overcome the above drawbacks.

SUMMARY OF THE INVENTION

An object of the present invention provides a slim-type keyboard device.

In accordance with an aspect of the present invention, there is provided a keyboard device. The keyboard device includes a base plate, a circuit board and plural keys. The base plate includes plural fixing parts. Each of the plural fixing parts includes two extension structures and an opening. The two extension structures are extended from the base plate and perpendicular to a top surface of the base plate. A guiding slot is defined by the two extension structures. The circuit board is disposed on the base plate. When the circuit board is triggered, a key signal is generated. The plural keys are disposed on the circuit board. Each of the plural keys includes a keycap and a metallic elastic element. The keycap includes plural positioning parts. The plural positioning parts are disposed on a bottom surface of the keycap, and connected with the corresponding fixing parts of the base plate. The metallic elastic element is located under the keycap to return the keycap to an original position. Each of the plural positioning parts includes a positioning bulge. The positioning bulge is introduced into the guiding slot through the opening of the fixing part. A first height of the positioning bulge is smaller than a second height of the guiding slot of the fixing part. A first width of the positioning bulge is greater than a second width of the opening of the fixing part. When the keycap is depressed, the positioning bulge of the positioning part is moved downwardly within the guiding slot, so that the keycap is moved toward the base plate.

In an embodiment, the plural fixing parts of the base plate include four fixing parts, the plural positioning parts of the keycap include four positioning parts, and the four fixing parts of the base plate are aligned with the four positioning parts of the keycap, respectively.

In an embodiment, the base plate is a metallic base plate, and the plural fixing parts are integrally formed with the base plate by a stamping process.

In an embodiment, the base plate includes plural perforations, and the plural fixing parts are plastic fixing parts, wherein the plural fixing parts are formed in the corresponding perforations of the base plate by a plastic injection molding process.

In an embodiment, the keyboard device further includes a restoring film. The metallic elastic element is disposed on the restoring film.

In an embodiment, the circuit board is a membrane circuit board, and the restoring film is attached on a top surface of the membrane circuit board.

In an embodiment, the keycap further includes a protrusion, and the protrusion is disposed on the bottom surface of the keycap. When the keycap is depressed, the circuit under the metallic elastic element is pressed by the protrusion of the keycap.

In accordance with another aspect of the present invention, there is provided a keyboard device. The keyboard device includes a base plate, a circuit board and plural keys. The base plate includes plural fixing parts. Each of the plural fixing parts includes two extension structures and an opening. The two extension structures are extended from the base plate and perpendicular to a top surface of the base plate. A guiding slot is defined by the two extension structures. The circuit board is disposed on the base plate. When the circuit board is triggered, a key signal is generated. The plural keys are disposed on the circuit board. Each of the plural keys includes a keycap and a restoring element. The keycap includes plural positioning parts. The plural positioning parts are disposed on a bottom surface of the keycap, and connected with the plural fixing parts of the base plate. The restoring element is located under the keycap and electrically connected with the circuit board to receive electricity from the circuit board. When the electricity is received by the restoring element, the restoring element is subjected to deformation to move the keycap away from the base plate. Each of the plural positioning parts includes a positioning bulge. The positioning bulge is introduced into the guiding slot through the opening of the fixing part. A first height of the positioning bulge is smaller than a second height of the guiding slot of the fixing part. A first width of the positioning bulge is greater than a second width of the opening of the fixing part. When the keycap is depressed, the positioning bulge of the positioning part is moved downwardly within the guiding slot, so that the keycap is moved toward the base plate. When the keycap is released, the restoring element moves the keycap away from the base plate.

In an embodiment, the base plate is a metallic base plate, and the plural fixing parts are integrally formed with the base plate by a stamping process.

In an embodiment, the base plate includes plural perforations, and the plural fixing parts are plastic fixing parts, wherein the plural fixing parts are formed in the corresponding perforations of the base plate by a plastic injection molding process.

In an embodiment, the restoring element is made of electroactive polymer (EAP).

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
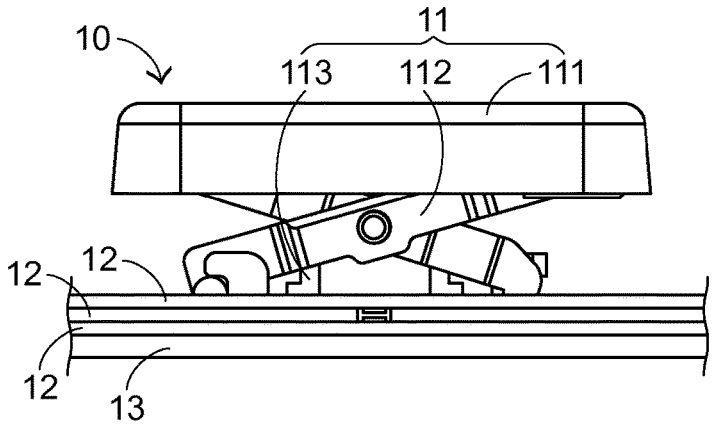
FIG.1 PRIOR ART
FIG. 1 is a schematic view illustrating a conventional keyboard device.
Figure 2:
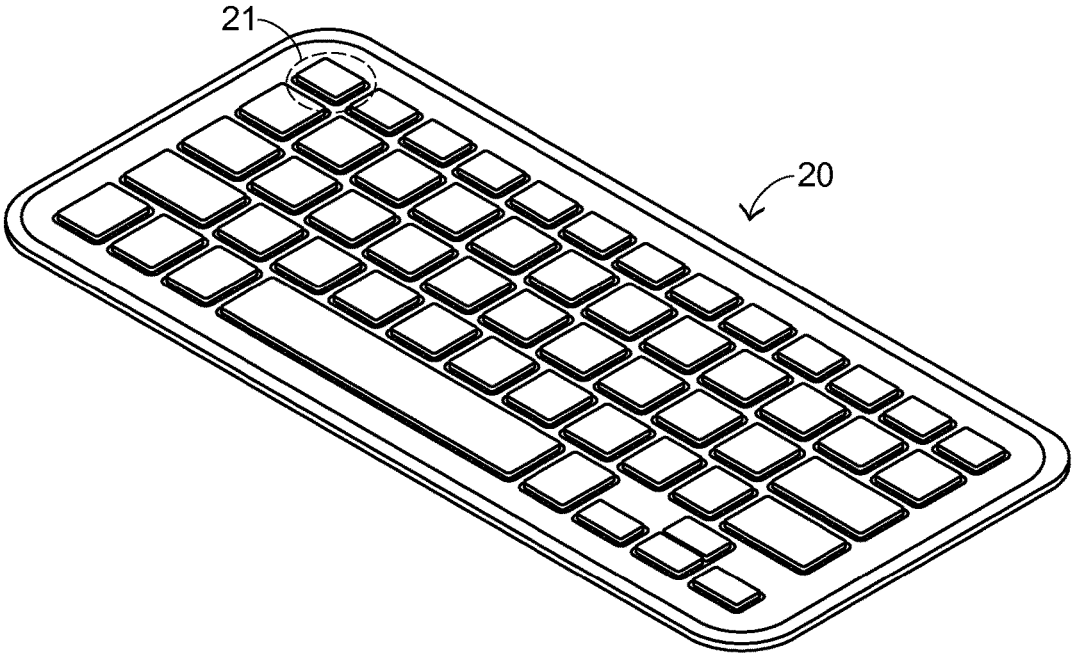
FIG. 2 is a schematic perspective view illustrating a keyboard device according to a first embodiment of the present invention.

FIG. 2 is a schematic perspective view illustrating a keyboard device according to a first embodiment of the present invention. As shown in FIG. 2, the keyboard device 20 comprises plural keys 21. For understanding the components and the assembling method of the keyboard device 20, only a single key will be illustrated as follows in order for clarification and brevity. The structure and the assembling method of the single key are similar to the structures and the assembling methods of the other keys. Consequently, the structures and the assembling methods of the other keys will not be redundantly described herein.

Figure 3:
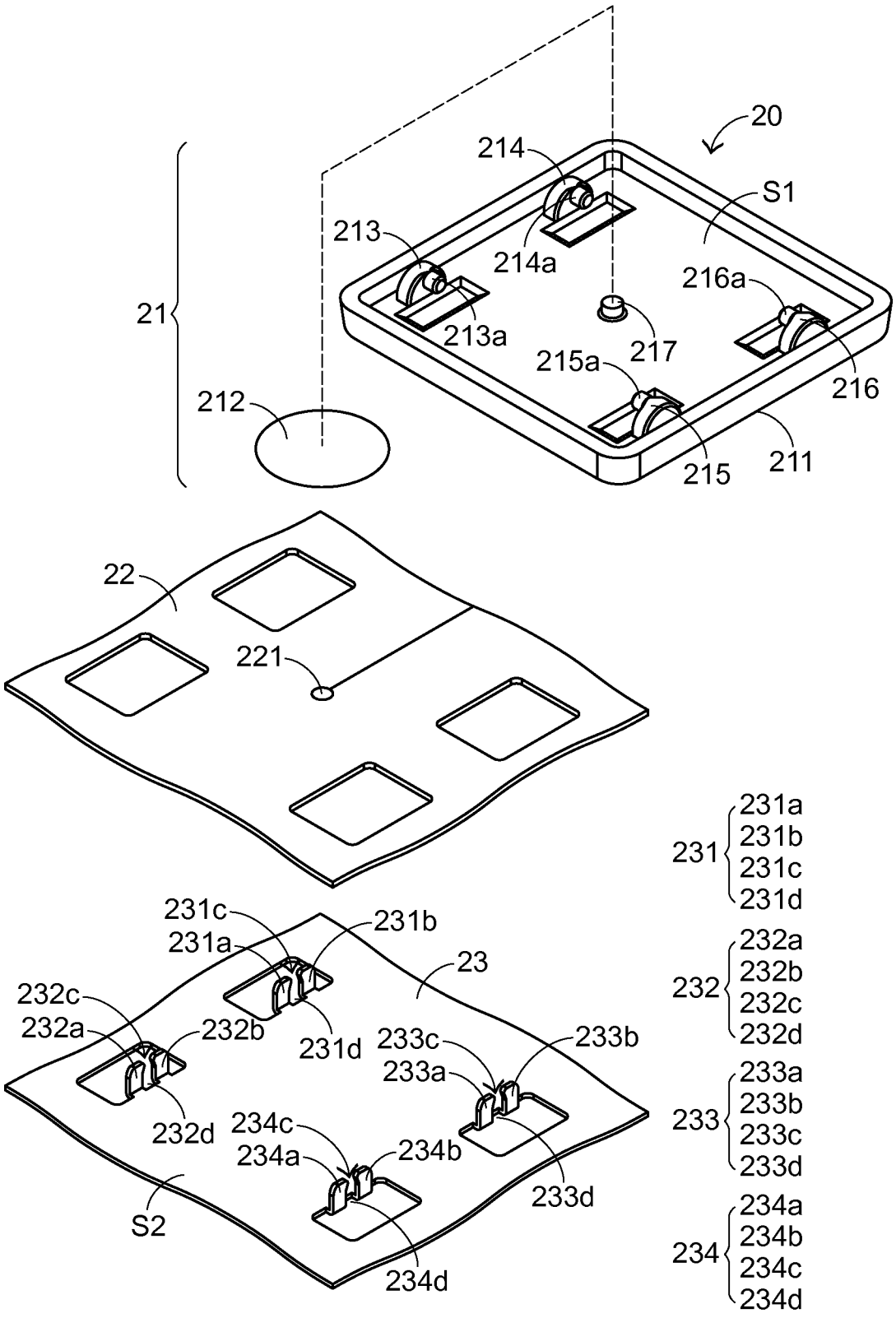
FIG. 3 is a schematic exploded view illustrating the keyboard device according to the first embodiment of the present invention.

FIG. 3 is a schematic exploded view illustrating the keyboard device according to the first embodiment of the present invention. As shown in FIG. 3, the keyboard device 20 comprises a key 21, a circuit board 22 and a base plate 23. The key 21 is disposed on the circuit board 22. The circuit board 22 is disposed on the base plate 23. The circuit board 22 comprises plural switching elements 221. For brevity, only one switching element 221 is shown in FIG. 3. The switching element 221 is located under the corresponding key 21 for generating a key signal. When the key 21 is depressed, the key 21 is contacted with the switching element 221 of the circuit board 22 so as to push the switching element 221. Consequently, the switching element 221 is triggered to generate the key signal. In this embodiment, the circuit board 22 is a well-known membrane circuit board. Moreover, the switching element 221 of the circuit board 22 is a membrane switch that is defined by two electrical contacts of an upper wiring board and a lower wiring board of the membrane circuit board. The structures of the membrane circuit board of this embodiment are similar to the membrane circuit board of the conventional keyboard, and are not redundantly described herein.

The key 21 comprises a keycap 211 and a metallic elastic element 212. The metallic elastic element 212 is located over the circuit board 22 and located under the keycap 211. The metallic elastic element 212 is used for returning the keycap 211 to its original position. An example of the metallic elastic element 212 includes but is not limited to a dome-shaped metal piece. Moreover, the keycap 211 has a bottom surface S1, plural positioning parts and a protrusion 217. The plural positioning parts comprise a first positioning part 213, a second positioning part 214, a third positioning part 215 and a fourth positioning part 216.

The first positioning part 213, the second positioning part 214, the third positioning part 215, the fourth positioning part 216 and the protrusion 217 are disposed on the bottom surface S1 of the keycap 211. Each fixing part comprises a positioning bulge. As shown in FIG. 3, the first positioning part 213 has a positioning bulge 213*a*, the second positioning part 214 has a positioning bulge 214*a*, the third positioning part 215 has a positioning bulge 215*a*, and the fourth positioning part 216 has a positioning bulge 216*a*. In this embodiment, the keycap 211 is made of a plastic material. Preferably but not exclusively, the first positioning part 213, the second positioning part 214, the third positioning part 215, the fourth positioning part 216 and the protrusion 217 are integrally formed on the bottom surface S1 of the keycap 211 by a plastic injection molding process.

In this embodiment, the keycap 211 has a rectangular shape, and the plural positioning parts comprise the four positioning parts. The first positioning part 213, the second positioning part 214, the third positioning part 215 and the fourth positioning part 216 are located at four corners of the bottom surface S1 of the keycap 211, respectively. Preferably but not exclusively, the protrusion 217 is located at a geometric center of the bottom surface S1 of the keycap 211. It is noted that the number of the positioning parts is not restricted. In some other embodiments, the number of the positioning parts is 3 or any other number. Moreover, the plural positioning parts and the protrusion are located at other locations of the keycap 211.

The base plate 23 is located under the key 21 and the circuit board 22. The base plate 23 is used for supporting the key 21 and the circuit board 22. The base plate 23 comprises plural fixing parts for connecting the corresponding positioning parts of the keycap 211 of the key 21. In this embodiment, the plural fixing parts comprise a first fixing part 231, a second fixing part 232, a third fixing part 233 and a fourth fixing part 234. The first fixing part 231, the second fixing part 232, the third fixing part 233 and the fourth fixing part 234 are aligned with the first positioning part 213, the second positioning part 214, the third positioning part 215 and the fourth positioning part 216 of the keycap 21, respectively. In particular, the first fixing part 231, the second fixing part 232, the third fixing part 233 and the fourth fixing part 234 are connected with the first positioning part 213, the second positioning part 214, the third positioning part 215 and the fourth positioning part 216 of the keycap 211, respectively. In this embodiment, the base plate 23 is a metallic base plate. Preferably but is not exclusively, the plural fixing parts 231, 232, 233 and 234 are integrally formed with the base plate 23 by a stamping process. In some other embodiments, the base plate 23 is a plastic base plate, and the plural fixing parts 231, 232, 233 and 234 are integrally formed with the base plate 23 by a plastic injection molding process.

Figure 4:
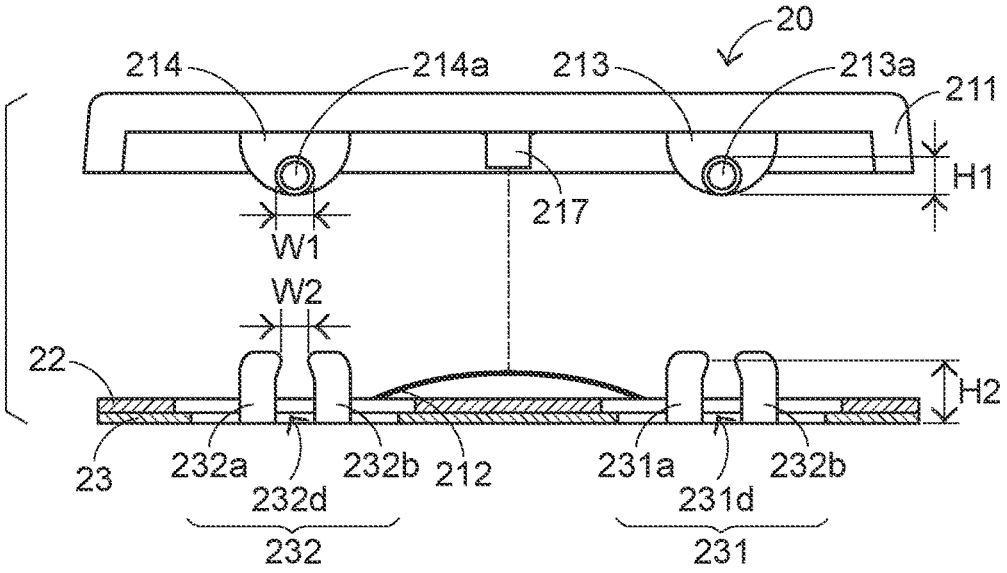
FIG. 4 is a schematic cross-sectional exploded view illustrating the keyboard device according to the first embodiment of the present invention.

Hereinafter, the structures of the fixing parts of the base plate 23 will be illustrated with reference to FIG. 4. FIG. 4 is a schematic cross-sectional exploded view illustrating the keyboard device according to the first embodiment of the present invention. Please refer to FIGS. 3 and 4. Each fixing part comprises two extension structures, an opening and a guiding slot. For example, the first fixing part 231 comprises two extension structures 231*a*, 231*b*, an opening 231*c* and a guiding slot 231*d*. The second fixing part 232 comprises two extension structures 232*a*, 232*b*, an opening 232*c* and a guiding slot 232*d*. The third fixing part 233 comprises two extension structures 233*a*, 233*b*, an opening 233*c* and a guiding slot 233*d*. The fourth fixing part 234 comprises two extension structures 234*a*, 234*b*, an opening 234*c* and a guiding slot 234*d*.

Hereinafter, the first fixing part 231 will be taken as an example. In the first fixing part 231, the extension structures 231*a* and 231*b* are extended from the base plate 23 and perpendicular to a top surface S2 of the base plate 23. The opening 231*c* is arranged between the distal ends of the extension structures 231*a* and 231*b*. Moreover, the guiding slot 231*d* is arranged between the two extension structures 231*a* and 231*b*. The positioning bulge 213*a* of the first positioning part 213 is introduced into the guiding slot 231*d* through the opening 231*c*. Consequently, the positioning bulge 213*a* of the first positioning part 213 is accommodated within the guiding slot 231*d*. The structures of the second fixing part 232, the third fixing part 233 and the fourth fixing part 234 are identical to the structures of the first fixing part 231, and are not redundantly described herein. That is, the positioning bulges 213*a*, 214*a*, 215*a* and 216*a* of the positioning parts 213, 214, 215 and 216 are introduced into the guiding slots 231*d*, 232*d*, 233*d* and 234*d* through the opening 231*c*, 232*c*, 233*c* and 234*c*, respectively. Consequently, the keycap 211 is fixed on the base plate 23.

The positioning parts of the keycap 211 and the fixing parts of the base plate 23 will be illustrated in more details as follows. Please refer to FIGS. 3 and 4 again. The positioning bulge of each positioning part (e.g., the positioning bulge 213*a* or 214*a*) has a first height H1 and a first width W1. The guiding slot of each fixing part (e.g., the guiding slot 231*d*) has a second height H2. The opening of each fixing part (e.g., the opening 232*c*) has a second width W2. The first height H1 of each positioning bulge is smaller than the second height H2 of each guiding slot. Moreover, the first width W1 of each positioning bulge is greater than the second width W2 of each opening. For example, the first height H1 of the positioning bulge 213*a* is smaller than the second height H2 of the guiding slot 231*d*, and the first width W1 of the positioning bulge 214*a* is greater than the second width W2 of the opening 232*c*.

Since the first width W1 of the positioning bulge is greater than the second width W2 of the opening of the fixing part, after the positioning bulge of the positioning part is introduced into the guiding slot through the opening of the fixing part, the positioning bulge will not be easily escaped from the guiding slot. Under this circumstance, the keycap 211 can be securely fixed on the base plate 23. Moreover, since the first height H1 of the positioning bulge of the positioning part is smaller than the second height H2 of the guiding slot of the fixing part, while the key 21 is depressed or released, the positioning bulge of the positioning part is moved upwardly or downwardly along the guiding slot of the fixing part. Under this circumstance, the key 21 is moved toward the base plate 23 or away from the base plate 23.

Figure 5:
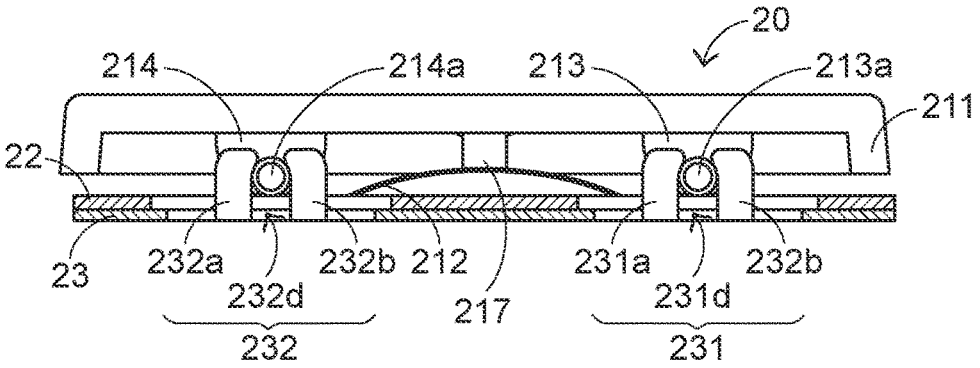
FIG. 5 schematically illustrates a key of the keyboard device according to the first embodiment of the present invention, in which the key is not depressed.
Figure 6:
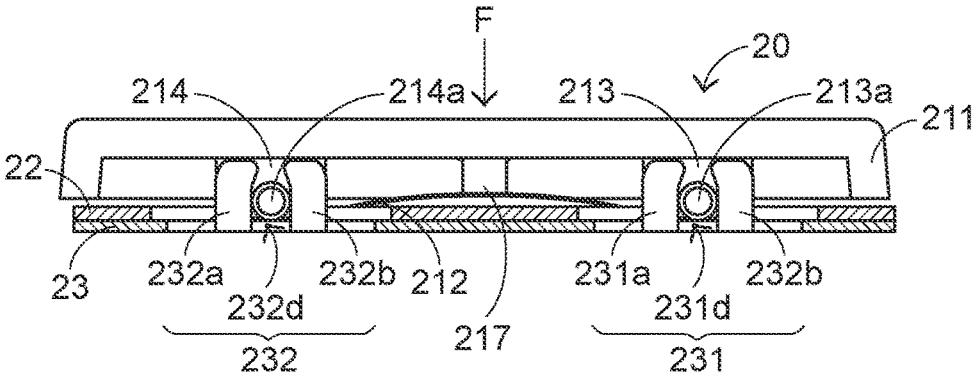
FIG. 6 schematically illustrates a key of the keyboard device according to the first embodiment of the present invention, in which the key is depressed.

The operations of the keyboard device of the present invention will be illustrated with reference to FIGS. 5 and 6. FIG. 5 schematically illustrates a key of the keyboard device according to the first embodiment of the present invention, in which the key is not depressed. FIG. 6 schematically illustrates a key of the keyboard device according to the first embodiment of the present invention, in which the key is depressed. As shown in FIG. 5, the metallic elastic element 212 has a cambered shape. The metallic elastic element 212 is located under the keycap 211 for restoring the shape of the keycap 211. The circuit board 22 is located under the metallic elastic element 212 for generating a key signal. The base plate 23 is located under the keycap 211, the metallic elastic element 212 and the circuit board 22 for supporting the keycap 211, the metallic elastic element 212 and the circuit board 22. As mentioned above, the positioning bulge 213*a* of the keycap 211 is disposed within the guiding slot 231*d* between the extension structures 231*a* and 231*b* of the base plate 23, and the positioning bulge 214*a* of the keycap 211 is disposed within the guiding slot 232*d* between the extension structures 232*a* and 232*b* of the base plate 23. Consequently, the keycap 211 is connected with the base plate 23.

As shown in FIG. 6, an external force F is applied to the keycap 211. In response to the external force F, the positioning bulge 213*a* of the first positioning part 213 is moved downwardly within the guiding slot 231*d* of the first fixing part 231, and the positioning bulge 214*a* of the second positioning part 214 is moved downwardly within the guiding slot 232*d* of the second fixing part 232. Consequently, the keycap 211 is moved toward the base plate 23. As the keycap 211 is moved toward the base plate 23, the metallic elastic element 212 is pressed down to result in deformation of the metallic elastic element 212. Consequently, the switching element 221 of the circuit board 22 (see FIG. 6) generates a key signal. When the external force F is no longer applied to the keycap 211 and the keycap 211 is released, the metallic elastic element 212 is restored to the cambered shape. Consequently, the keycap 211 is correspondingly moved away from the base plate 23.

It is noted that numerous modifications and alterations may be made while retaining the teachings of the invention. For increasing the travelling path of the key 21, the keycap 211 is further equipped with plural holes (not shown) corresponding to the extension structures 231*a*, 231*b*, 232*a* and 232*b* of the base plate 23. When the keycap 211 is depressed and the keycap 211 is moved toward the base plate 23, the positioning bulge 213*a* of the first positioning part 213 is moved downwardly within the guiding slot 231*d* of the first fixing part 231. Since the keycap 211 has the plural holes, when the extension structures 231*a*, 231*b*, 232*a* and 232*b* of the base plate 23 are close to the bottom surface S1 of the keycap 211, the extension structures 231*a*, 231*b*, 232*a* and 232*b* of the base plate 23 are inserted into the corresponding holes of the keycap 211. Consequently, the depressed keycap 211 is can be closer to the base plate 23.

Figure 7:
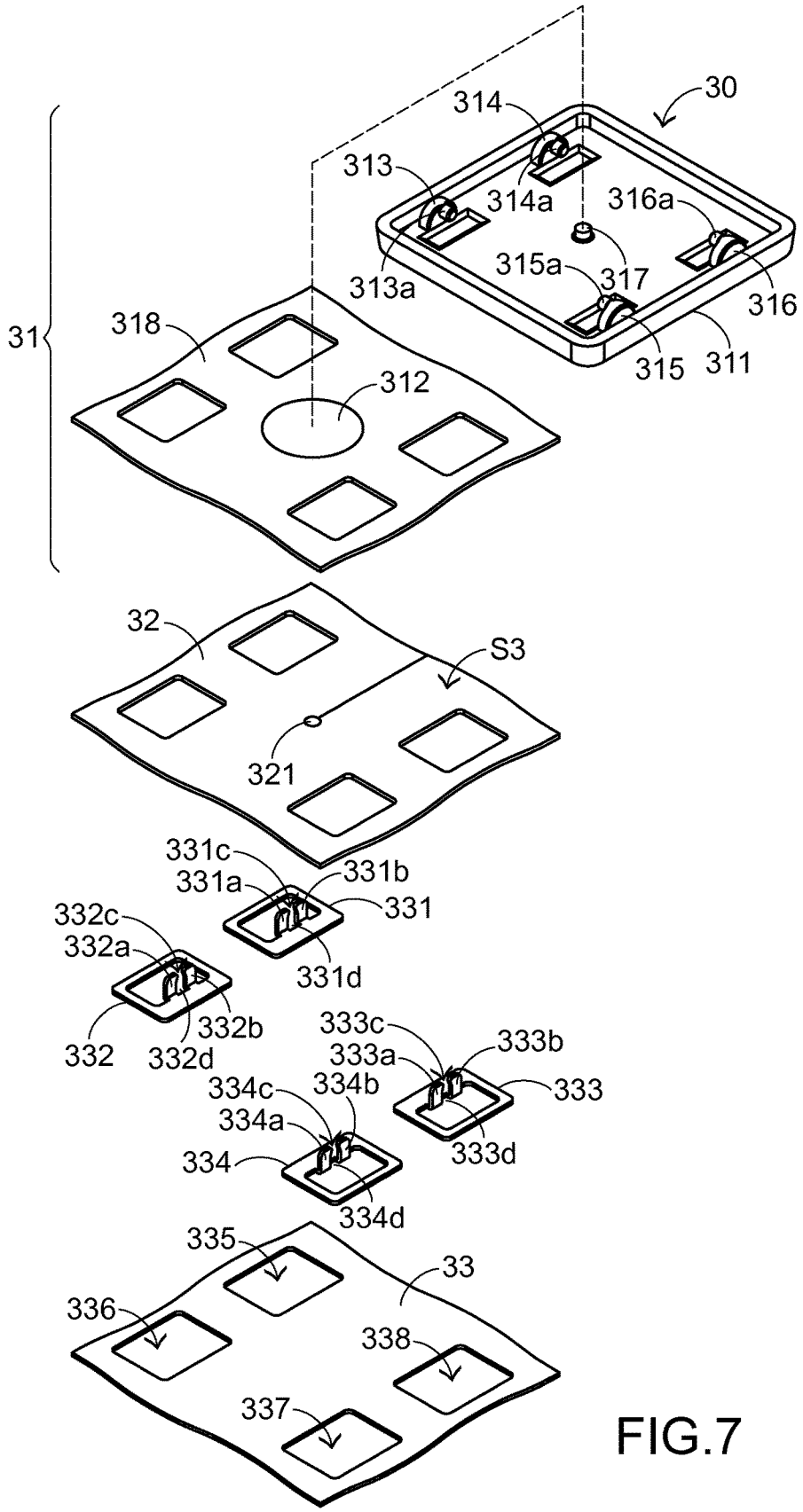
FIG. 7 is a schematic exploded view illustrating the keyboard device according to a second embodiment of the present invention.

FIG. 7 is a schematic exploded view illustrating the keyboard device according to a second embodiment of the present invention. As shown in FIG. 7, the keyboard device 30 comprises plural keys 31, a circuit board 32 and a base plate 33. For brevity, only one key 31 is shown in FIG. 7. The key 31 is disposed on the circuit board 32. The circuit board 32 is disposed on the base plate 33. The circuit board 32 comprises plural switching elements 321. For brevity, only one switching element 321 is shown in FIG. 7. The switching element 321 is located under the corresponding key 31 for generating a key signal.

In comparison with the first embodiment of FIG. 3, the keyboard device of the second embodiment further comprises a restoring film 318 for supporting the metallic elastic elements 312 of all keys 31, the base plate 33 of the keyboard device of the second embodiment comprises plural perforations 335, 336, 337 and 338, and the fixing parts 331, 332, 333 and 334 are respectively disposed within the perforations 335, 336, 337 and 338. The structures and assembling methods of other components of the second embodiment are similar to those of the first embodiment, and are not redundantly described herein. The way of installing the metallic elastic elements 312 on the restoring film 318 and the relationships between the fixing parts 331, 332, 333 and 334 and the perforations 335, 336, 337 and 338 of the base plate 33 will be illustrated in more details as follows.

The key 31 comprises the keycap 311, the metallic elastic element 312 and a portion of the restoring film 318. The metallic elastic element 312 is disposed on the restoring film 318. Preferably but not exclusively, the metallic elastic element 312 is disposed on a top surface of the restoring film 318. The keycap 311 comprises a first positioning part 313, a second positioning part 314, a third positioning part 315, a fourth positioning part 316 and a protrusion 317. The first positioning part 313 has a positioning bulge 313*a*, the second positioning part 314 has a positioning bulge 314*a*, the third positioning part 315 has a positioning bulge 315*a*, and the fourth positioning part 316 has a positioning bulge 316*a*. For assembling the keyboard device 30, each metallic elastic element 312 is fixed on the top surface or a bottom surface of the restoring film 318 by an adhering means or any other appropriate fixing means, and then the restoring film 318 is attached on a top surface S3 of the circuit board 32. Consequently, each metallic elastic element 312 is located under the corresponding keycap 311. Under this circumstance, the assembling efficiency of the keyboard device 30 is enhanced.

The base plate 33 comprises a first fixing part 331, a second fixing part 332, a third fixing part 333, a fourth fixing part 334 and plural perforations 335, 336, 337 and 338. The first fixing part 331 comprises two extension structures 331*a*, 331*b*, an opening 331*c* and a guiding slot 331*d*. The second fixing part 332 comprises two extension structures 332*a*, 332*b*, an opening 332*c* and a guiding slot 332*d*. The third fixing part 333 comprises two extension structures 333*a*, 333*b*, an opening 333*c* and a guiding slot 333*d*. The fourth fixing part 334 comprises two extension structures 334*a*, 334*b*, an opening 334*c* and a guiding slot 334*d*. The structures of the plural fixing parts 331, 332, 333 and 334 of the second embodiment are similar to those of the fixing parts 231, 232, 233 and 234 of the first embodiment of FIG. 3. The connecting relationships between the plural fixing parts 331, 332, 333 and 334 of the base plate 33 and the plural positioning parts 313, 314, 315 and 316 are similar to the connecting relationships between the plural fixing parts 231, 232, 233 and 234 and the plural positioning parts 213, 214, 215 and 216 of the keycap 211 of FIG. 3, and are not redundantly described.

In this embodiment, an example of the base plate 33 includes but is not limited to a metallic base plate. The base plate 33 comprises the plural perforations 335, 336, 337 and 338. The first fixing part 331, the second fixing part 332, the third fixing part 333 and the fourth fixing part 334 are plastic fixing parts. Moreover, the plural fixing parts 331, 332, 333 and 334 are formed in the corresponding perforations 335, 336, 337 and 338 of the base plate 33 by a plastic injection molding process.

Figure 8:
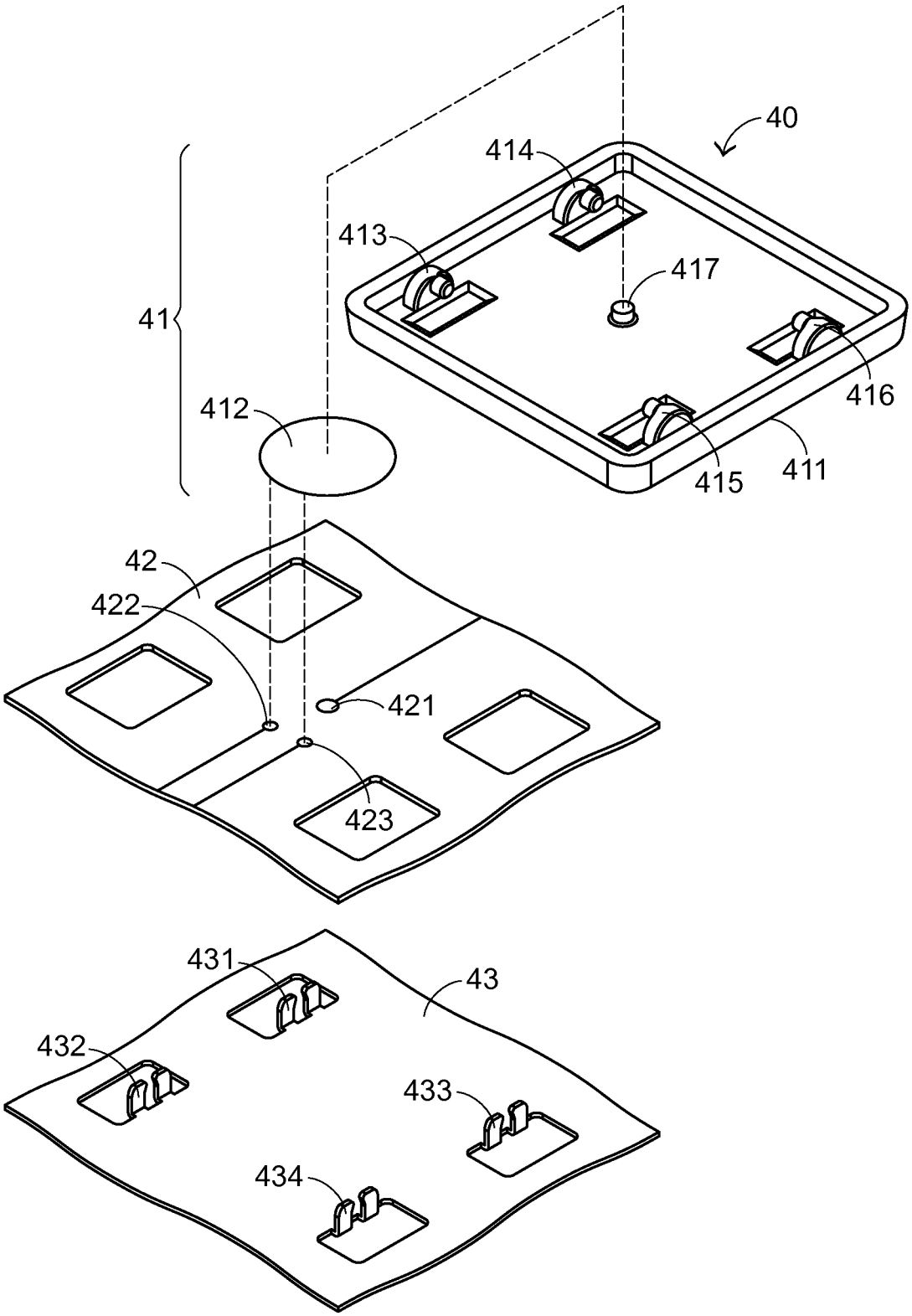
FIG. 8 is a schematic exploded view illustrating the keyboard device according to a third embodiment of the present invention.

FIG. 8 is a schematic exploded view illustrating the keyboard device according to a third embodiment of the present invention. As shown in FIG. 8, the keyboard device 40 comprises plural keys 41, a circuit board 42 and a base plate 43. For brevity, only one key 41 is shown in FIG. 8. The key 41 is disposed on the circuit board 42. The circuit board 42 is disposed on the base plate 43. The circuit board 42 comprises plural switching elements 421. For brevity, only one switching element 421 is shown in FIG. 8. The switching element 421 is located under the corresponding key 41 for generating a key signal.

The key 41 comprises a keycap 411 and a restoring element 412. The keycap 411 comprises a first positioning part 413, a second positioning part 414, a third positioning part 415, a fourth positioning part 416 and a protrusion 417. The base plate 43 comprises a first fixing part 431, a second fixing part 432, a third fixing part 433 and a fourth fixing part 434. In this embodiment, the first positioning part 413, the second positioning part 414, the third positioning part 415, the fourth positioning part 416 and the protrusion 417 are integrally formed with the keycap 411 by a plastic injection molding process. Preferably but not exclusively, the base plate 43 is a metallic base plate, and the plural fixing parts 431, 432, 433 and 434 are integrally formed with the base plate 43 by a stamping process. In some other embodiments, the base plate 43 comprises plural perforations, the plural fixing parts 431, 432, 433 and 434 are plastic fixing parts, and the plural fixing parts 431, 432, 433 and 434 are formed in the corresponding perforations of the base plate 43 by a plastic injection molding process.

Except that the restoring element 412 is used for returning the keycap 411 to the original position and the restoring element 412 is made of electroactive polymer (EAP), the structures and assembling methods of other components of the keyboard device of this embodiment are substantially identical to those of the first embodiment of FIG. 3 and are not redundantly described herein.

Moreover, the circuit board 43 further comprises a first electrical contact 422 and a second electrical contact 423. The restoring element 412 is disposed on the circuit board 42, and electrically connected with the first electrical contact 422 and the second electrical contact 423 of the circuit board 42 so as to acquire electricity from the circuit board 42. In case that no electricity is received by the restoring element 412, the restoring element 412 has a flat circular shape. Whereas, in case that the electricity is received by the restoring element 412, the restoring element 412 is subjected to deformation and the flat circular shape is switched to a cambered dome shape. Consequently, when the electricity is received by the restoring element 412, the keycap 411 is moved away from the base plate 43 in response to the deformation of the restoring element 412. It is noted that the shape of the restoring element 412 is not restricted to the circular shape. For example, in another embodiment, the restoring element 412 has a rectangular shape.

Figure 9:
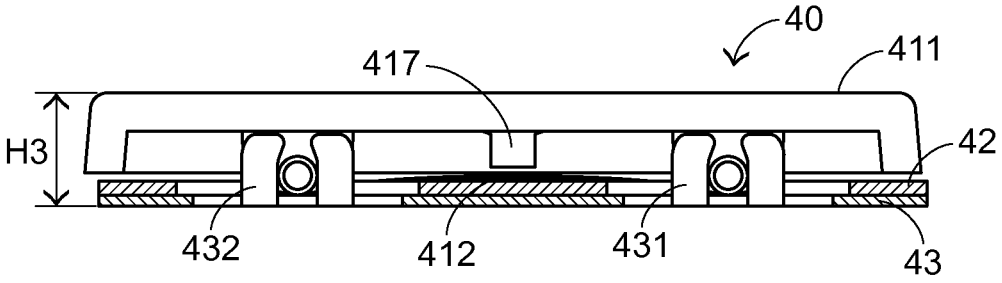
FIG. 9 schematically illustrates the key according to the third embodiment of the present invention, in which no electricity is received by the restoring element.
Figure 10:
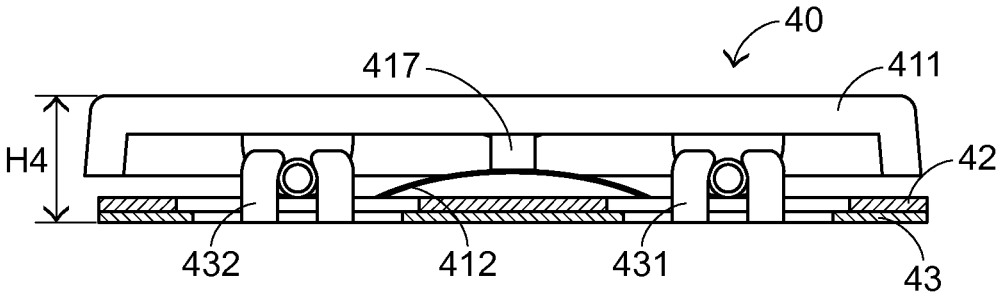
FIG. 10 schematically illustrates the key according to the third embodiment of the present invention, in which the electricity is received by the restoring element.

The operations of the key 41 will be illustrated with reference to FIGS. 9 and 10. FIG. 9 schematically illustrates the key according to the third embodiment of the present invention, in which no electricity is received by the restoring element. FIG. 10 schematically illustrates the key according to the third embodiment of the present invention, in which the electricity is received by the restoring element. As shown in FIG. 9, the keyboard device 40 is not electrically connected with an electronic device (e.g., a computer) or a power switch of the keyboard device 40 is not turned on. Since no electricity is received by the restoring element 412, the restoring element 412 has the flat circular shape. Meanwhile, the distance between the keycap 411 and the bottom of the base plate 43 is equal to a third height H3.

When the keyboard device 40 is electrically connected with the electronic device (e.g., the computer) or the power switch of the keyboard device 40 is turned on, the electricity from the circuit board 4 is transmitted to the power consumption components of the keyboard device 40. For example, one of the power consumption components is the restoring element 412. As shown in FIG. 10, the restoring element 412 receives the electricity. Consequently, the restoring element 412 is subjected to deformation, and the restoring element 412 is switched from the flat circular shape to the cambered dome shape so as to drive movement of the keycap 411. Meanwhile, the distance between the keycap 411 and the bottom of the base plate 43 is increased to a fourth height H4.

When an external force is applied to the keycap 411, the keycap 411 is moved downwardly. As the keycap 411 is moved downwardly, the protrusion 417 is contacted with the restoring element 412 to press the restoring element 412. Consequently, the switching element 421 of the circuit board 42 (not shown) is triggered to generate the key signal. An example of the circuit board 42 includes but is not limited to a membrane switch circuit, a capacitive sensing circuit or any other appropriate sensing circuit. For example, if the switching element 421 is the membrane switch circuit, the depressed restoring element 412 is contacted with the switching element 421 to push the switching element 421. Consequently, the circuitry of the switching element 421 is electrically conducted to generate the key signal. If the switching element 421 is the capacitive sensor and the depressed restoring element 412 is close to the switching element 421, the switching element 421 senses the change of the capacitance value. According to the change of the capacitance value, the key signal is generated When the keycap 411 is released, the shape of the restoring element 413 is restored to the cambered dome shape because the electricity is still received by the restoring element 413. By means of the restoring element 413, the keycap 411 is returned to the original position, so that the distance between the keycap 411 and the bottom of the base plate 43 is increased to the fourth height H4 again. Consequently, the keycap 411 is moved away from the base plate 43. Similarly, when the external force is applied to the keycap 411 of the key 41 again, the keycap 411 is moved downwardly again. Consequently, the switching element 421 is triggered to generate the key signal.

From the above descriptions, the present invention provides the keyboard device. The keycap is directly fixed on the base plate through the plural positioning parts of the keycap and the plural fixing parts of the base plate. Since the keycap is fixed on the base plate without the need of using the scissors member or other connecting element, the assembling process of the keyboard device is simplified and the fabricating cost of the keyboard device is reduced. Since no scissors member is arranged between the keycap and the base plate and the height of the restoring element or the metallic elastic element of the keyboard device of the present invention is smaller than the height of the rubbery elastomer of the conventional keyboard device, the overall height of the keyboard device of the present invention is reduced. In other words, the keyboard device of the present invention is slimmer than the conventional keyboard device.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device, comprising:

a base plate comprising plural fixing parts, wherein each of the plural fixing parts comprises two extension structures and an opening, wherein the two extension structures are extended from the base plate and perpendicular to a top surface of the base plate, and a guiding slot is defined by the two extension structures; and a circuit board disposed on the base plate, wherein when the circuit board is triggered, a key signal is generated;

plural keys disposed on the circuit board, wherein each of the plural keys comprises:

a keycap comprising plural positioning parts, wherein the plural positioning parts are disposed on a bottom surface of the keycap, and connected with the plural fixing parts of the base plate; and a restoring element located under the keycap and electrically connected with the circuit board to receive electricity from the circuit board, wherein when the electricity is received by the restoring element, the restoring element is subjected to deformation to move the keycap away from the base plate, wherein each of the plural positioning parts comprises a positioning bulge, and the positioning bulge is introduced into a corresponding guiding slot through the opening of a corresponding fixing part, wherein a first height of the positioning bulge is smaller than a second height of the corresponding guiding slot of the corresponding fixing part, and a first width of the positioning bulge is greater than a second width of the opening of the corresponding fixing part, wherein when the keycap is depressed, the positioning bulge of the positioning part is moved downwardly within the corresponding guiding slot, so that the keycap is moved toward the base plate, wherein when the keycap is released, the restoring element moves the keycap away from the base plate.

2. The keyboard device according to claim 1, wherein the base plate is a metallic base plate, and the plural fixing parts are integrally formed with the base plate by a stamping process.

3. The keyboard device according to claim 1, wherein the base plate comprises plural perforations, and the plural fixing parts are plastic fixing parts, wherein the plural fixing parts are formed in corresponding perforations of the base plate by a plastic injection molding process.

4. The keyboard device according to claim 1, wherein the restoring element is made of electroactive polymer (EAP).

* * * * *